US009279229B2

(12) United States Patent
Doll et al.

(10) Patent No.: US 9,279,229 B2
(45) Date of Patent: Mar. 8, 2016

(54) FLUID CONVEYANCE SYSTEM

(71) Applicant: Harnischfeger Technologies, Inc., Wilmington, DE (US)

(72) Inventors: Robert Doll, Nashotah, WI (US); Christopher S. Jones, Milwaukee, WI (US); Jesse Knoble, Oshkosh, WI (US); Matthew Loew, Hartland, WI (US); Russell Luzinski, Oak Creek, WI (US); Daniel Schlegel, Germantown, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 47 days.

(21) Appl. No.: 14/057,068

(22) Filed: Oct. 18, 2013

(65) Prior Publication Data

US 2014/0112748 A1 Apr. 24, 2014

Related U.S. Application Data

(60) Provisional application No. 61/716,072, filed on Oct. 19, 2012.

(51) Int. Cl.

| | |
|---|---|
| ***E02F 3/36*** | (2006.01) |
| ***E02F 3/30*** | (2006.01) |
| ***E02F 3/46*** | (2006.01) |
| ***E02F 9/22*** | (2006.01) |

(52) U.S. Cl.

CPC . *E02F 3/36* (2013.01); *E02F 3/304* (2013.01); *E02F 3/46* (2013.01); *E02F 9/2271* (2013.01); *E02F 9/2275* (2013.01); *Y10T 137/85978* (2015.04)

(58) Field of Classification Search

CPC ..... E02F 3/304; E02F 3/651; E02F 3/3663
USPC ..... 92/110–112, 117 A; 137/580; 138/42, 138/114, 115, 118–120; 414/685, 690, 414/695.5, 699, 708

See application file for complete search history.

(56) References Cited

U.S. PATENT DOCUMENTS

| | | | | |
|---|---|---|---|---|
| 3,219,213 | A * | 11/1965 | Learmont | 414/692 |
| 3,628,675 | A | 12/1971 | Balogh | |
| 5,820,074 | A * | 10/1998 | Trommer et al. | 244/58 |
| 2012/0076628 | A1 * | 3/2012 | Gilmore | E02F 9/2267 414/687 |

* cited by examiner

*Primary Examiner* — Ernesto Suarez
*Assistant Examiner* — Ronald Jarrett
(74) *Attorney, Agent, or Firm* — Michael Best & Friedrich LLP

(57) ABSTRACT

An industrial machine includes a frame supporting a fluid source and a boom, an arm, an attachment coupled to the arm, a cylinder, and a rod. The arm is movably coupled to the boom for translational and rotational movement relative to the boom. The cylinder includes a first end and a second end, and the cylinder defines an internal bore in fluid communication with the fluid source. The rod is coupled to the arm and is slidably received within the cylinder. The rod includes a port and a passage for providing fluid to the attachment. The port provides fluid communication between the internal bore and the passage. The port is positioned within the internal bore throughout the entire range of movement of the rod relative to the cylinder.

20 Claims, 6 Drawing Sheets

FLUID CONVEYANCE SYSTEM

CROSS REFERENCE TO RELATED APPLICATION

This application claims the benefit of and priority to U.S. Provisional Patent Application No. 61/716,072, filed Oct. 19, 2012, the entire contents of which is incorporated by reference herein.

BACKGROUND

The present invention relates to industrial machines. Specifically, the present invention relates to a fluid conveyance system for an earthmoving machine attachment.

Conventional rope shovels include a frame supporting a boom and a handle coupled to the boom for rotational and translational movement. A dipper is attached to the handle and is supported by a cable or rope that passes over an end of the boom. The rope is secured to a bail that is pivotably coupled to the dipper. During the hoist phase, the rope is reeled in by a hoist drum, lifting the dipper upward through a bank of material and liberating a portion of the material. The orientation of the dipper relative to the handle is generally fixed and cannot be controlled independently of the handle and the hoist rope.

SUMMARY

In one aspect, the invention provides an industrial machine including a frame supporting a fluid source and a boom, an arm, an attachment coupled to the arm, a cylinder, and a rod. The arm is movably coupled to the boom for translational and rotational movement relative to the boom. The cylinder includes a first end and a second end, and the cylinder defines an internal bore in fluid communication with the fluid source. The rod is coupled to the arm and is slidably received within the cylinder. The rod includes a port and a passage for providing fluid to the attachment. The port provides fluid communication between the internal bore and the passage. The port is positioned within the internal bore throughout the entire range of movement of the rod relative to the cylinder.

In another aspect, the invention provides an industrial machine including a frame, an elongated arm, an attachment, a first member, and a second member. The frame supports a boom and a fluid source. The boom includes a first end and a second end opposite the first end. The elongated arm is movably coupled to the boom and includes a first end and a second end. The attachment is coupled to the first end of the elongated member. The first member has a first end and a second end and defines a first chamber in fluid communication with the fluid source. The second member at least partially extends through the first member. The second member includes a second chamber in fluid communication with the first chamber and in fluid communication with the attachment. The second member is movable relative to the first member as the arm moves relative to the boom.

In yet another aspect, the invention provides a fluid conveyance system for an industrial machine, the industrial machine having a frame supporting a boom including a saddle block, an arm having a first end and a second end and supported by the saddle block for movement relative to the boom, and an attachment coupled to the second end of the arm. The fluid conveyance system includes a fluid source, a conduit in fluid communication with the fluid source, a cylinder, and a rod slidably received within the cylinder. The cylinder includes a first end and a second end and defines an internal bore in fluid communication with the conduit. The rod is slidably received within the cylinder and supported by the arm. The rod includes a port and a passage for providing fluid to the attachment. The port provides fluid communication between the internal bore and the passage and is positioned within the internal bore throughout the range of movement of the rod relative to the cylinder.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
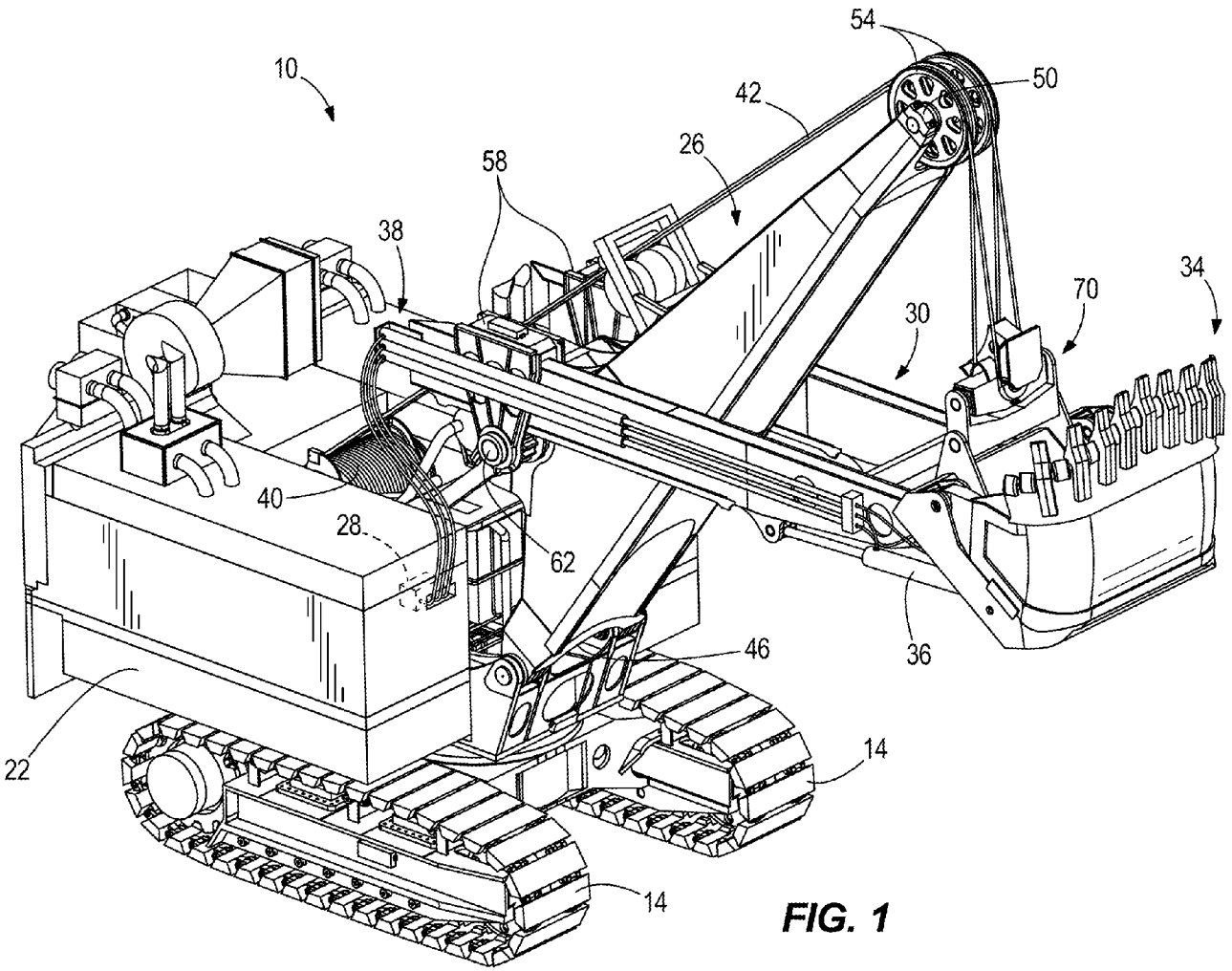
FIG. 1 is a perspective view of a shovel.

As shown in FIG. 1, a mining shovel 10 is supported by tracks 14 on a support surface or ground (not shown). The shovel 10 includes frame 22 supporting a boom 26 and a fluid source 28 (e.g., a fluid pump or tank), an elongated member or handle 30, an attachment or bucket 34 including pivot actuators 36, and a fluid conveyance system 38. The frame 22 includes a rotational structure for rotating about an axis of rotation (not shown) that is generally perpendicular to a plane corresponding to a grade of the support surface. The frame 22 also includes a hoist drum 40 for reeling in and paying out a cable or rope 42.

Figure 2:
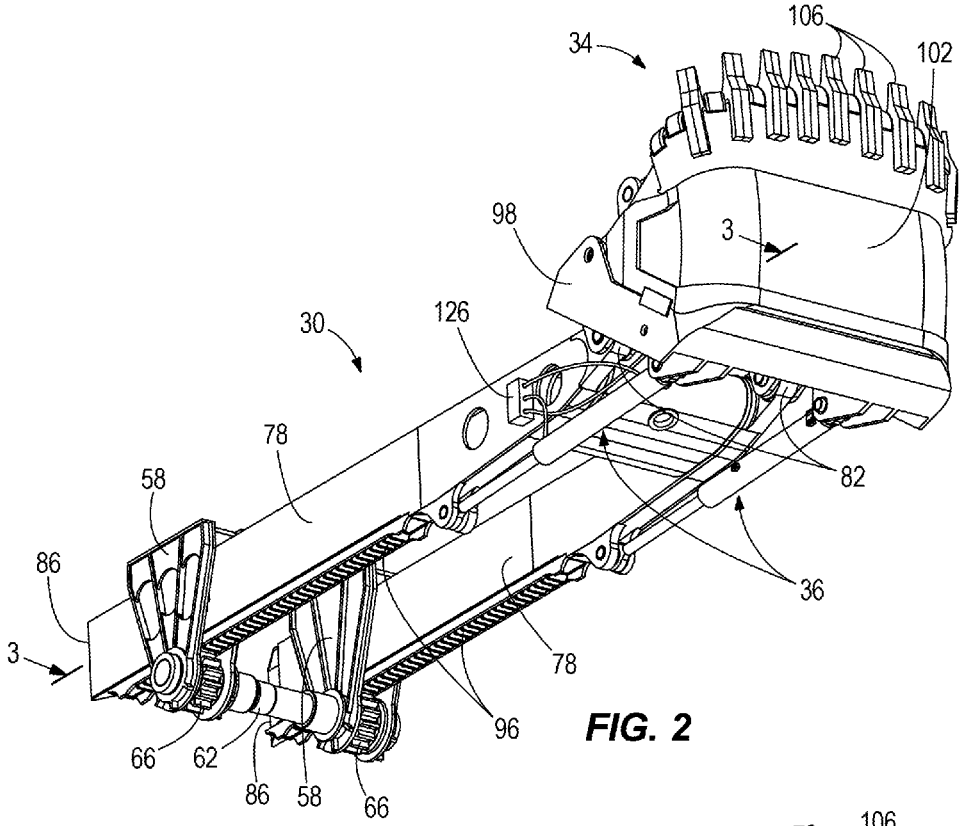
FIG. 2 is a perspective view of a handle, a saddle block, a shipper shaft, and a bucket.

The boom 26 includes a first end 46 coupled to the frame 22, a second end 50 opposite the first end 46, a boom sheave 54, saddle blocks 58, and a shipper shaft 62. The boom sheave 54 is coupled to the second end 50 of the boom 26 and guides the rope 42 over the second end 50. The rope 42 is coupled to the bucket 34 by a bail 70, and the bucket 34 is raised or lowered as the rope 42 is reeled in or paid out, respectively, by the hoist drum 40. The shipper shaft 62 extends through the boom 26 and is positioned between the first end 46 and the second end 50 of the boom 26. In the illustrated embodiment, the shipper shaft 62 is rotatable about an axis defined by the shipper shaft 62 and is oriented transverse to a longitudinal axis of the boom 26. The shipper shaft 62 includes one or more pinions 66 (FIG. 2). The saddle blocks 58 are rotatably coupled to the boom 26 by the shipper shaft 62. In one embodiment, each saddle block 58 is a three-piece saddle block having two parallel side portions and a top portion extending between the side portions.

Figure 3:
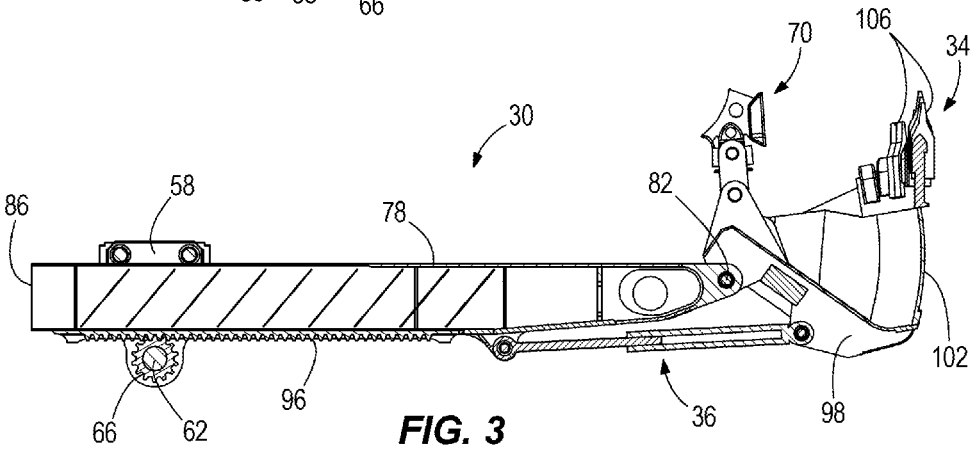
FIG. 3 is a section view of the handle, saddle block, shipper shaft, and bucket of FIG. 2 taken along section 3-3.

As shown in FIGS. 2 and 3, the handle 30 includes a pair of parallel arms 78 and defines a first end 82 and a second end 86. The first end 82 is pivotably coupled to the bucket 34. The second end 86 is movably received in the saddle blocks 58, which is rotatable relative to the boom 26 (FIG. 1) about the shipper shaft 62. In the illustrated embodiment, the handle arms 78 are positioned on either side of the boom 26 and movably pass through each saddle block 58 such that the handle 30 is capable of rotational and translational movement relative to the boom 26. Stated another way, the handle 30 is linearly extendable relative to the saddle block 58 and is rotatable about the shipper shaft 62. In addition, each arm 78 includes a rack 96 for engaging the pinion 66 of the shipper shaft 62, forming a rack-and-pinion coupling between the handle 30 and the boom 26 (FIG. 1). Rotation of the shipper shaft 62 about its axis moves the rack 96 along the shipper shaft 62, facilitating translational movement of the handle 30 relative to the boom 26.

In the illustrated embodiment, the bucket 34 is a clamshell-type bucket 34 having a rear wall 98 and a main body 102 that can be separated from the rear wall 98 to empty the contents of the bucket 34. The main body 102 may be actuated by one or more bucket cylinders (not shown). In other embodiments, the shovel 10 may include other types of attachments, buckets, or dippers. Each pivot actuator 36 is coupled between the bucket 34 and the handle 30. The pivot actuators 36 actively control the pitch of the bucket 34 (i.e., the angle of the bucket 34 relative to the handle 30) by rotating the bucket 34 about the handle first end 82. In the illustrated embodiment, the pivot actuators 36 are hydraulic cylinders. The bucket 34 also includes teeth 106 for engaging a bank of material. The bucket 34 is used to excavate a desired work area, collect material, and transfer the collected material to a desired location (e.g., a material handling vehicle).

Figure 4:
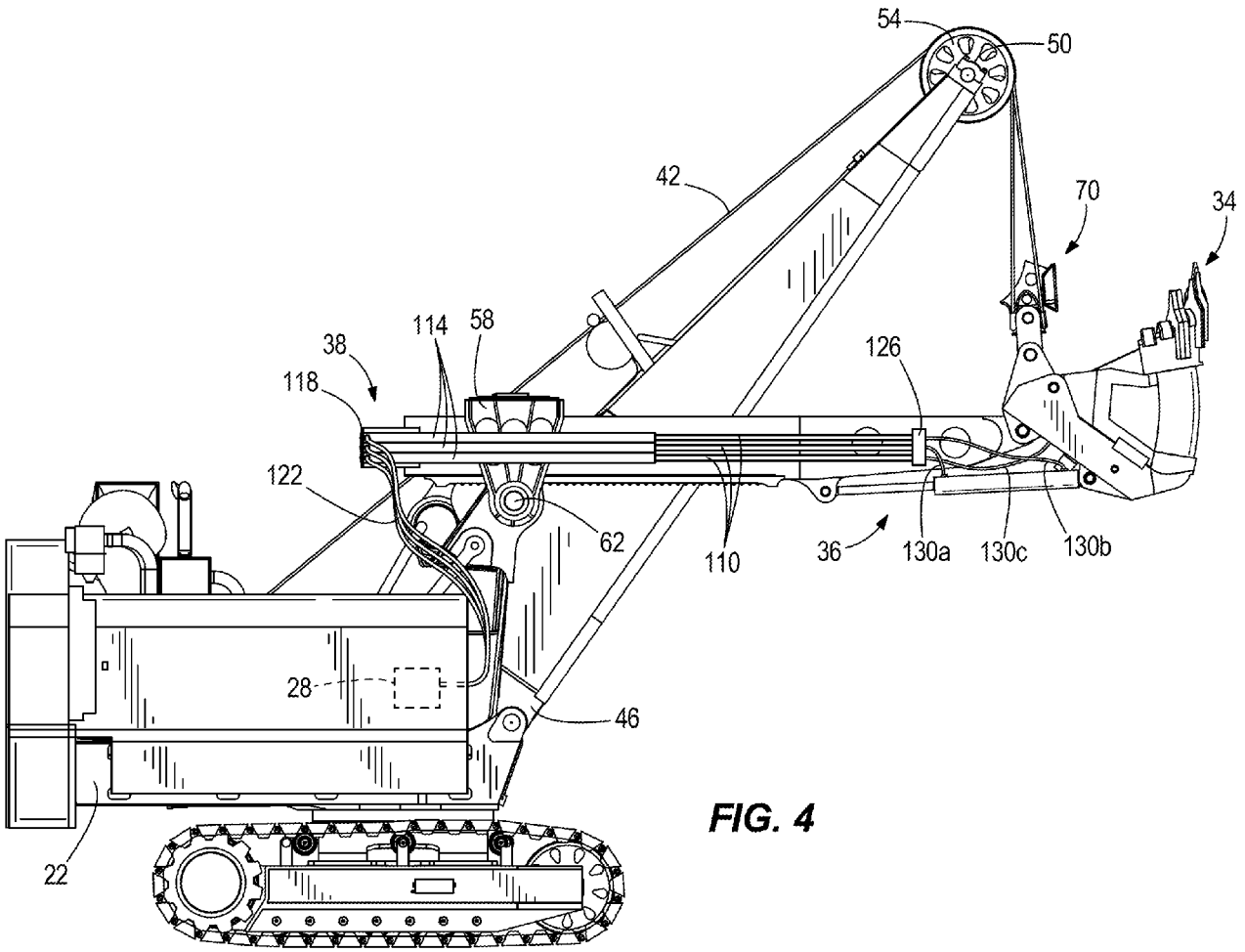
FIG. 4 is a side view of the shovel of FIG. 1.
Figure 5:
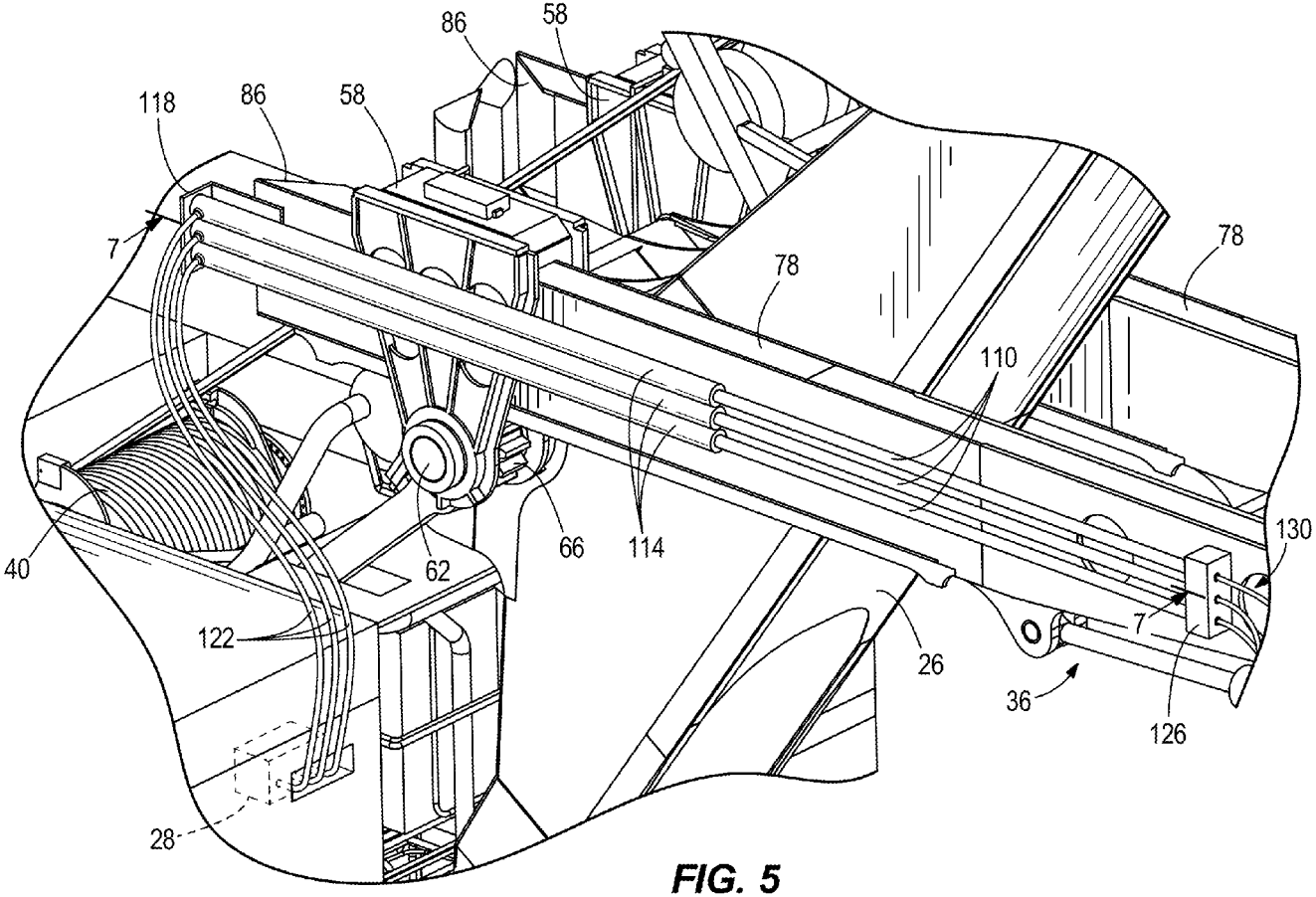
FIG. 5 is a perspective view of a fluid conveyance system with the handle extended.
Figure 6:
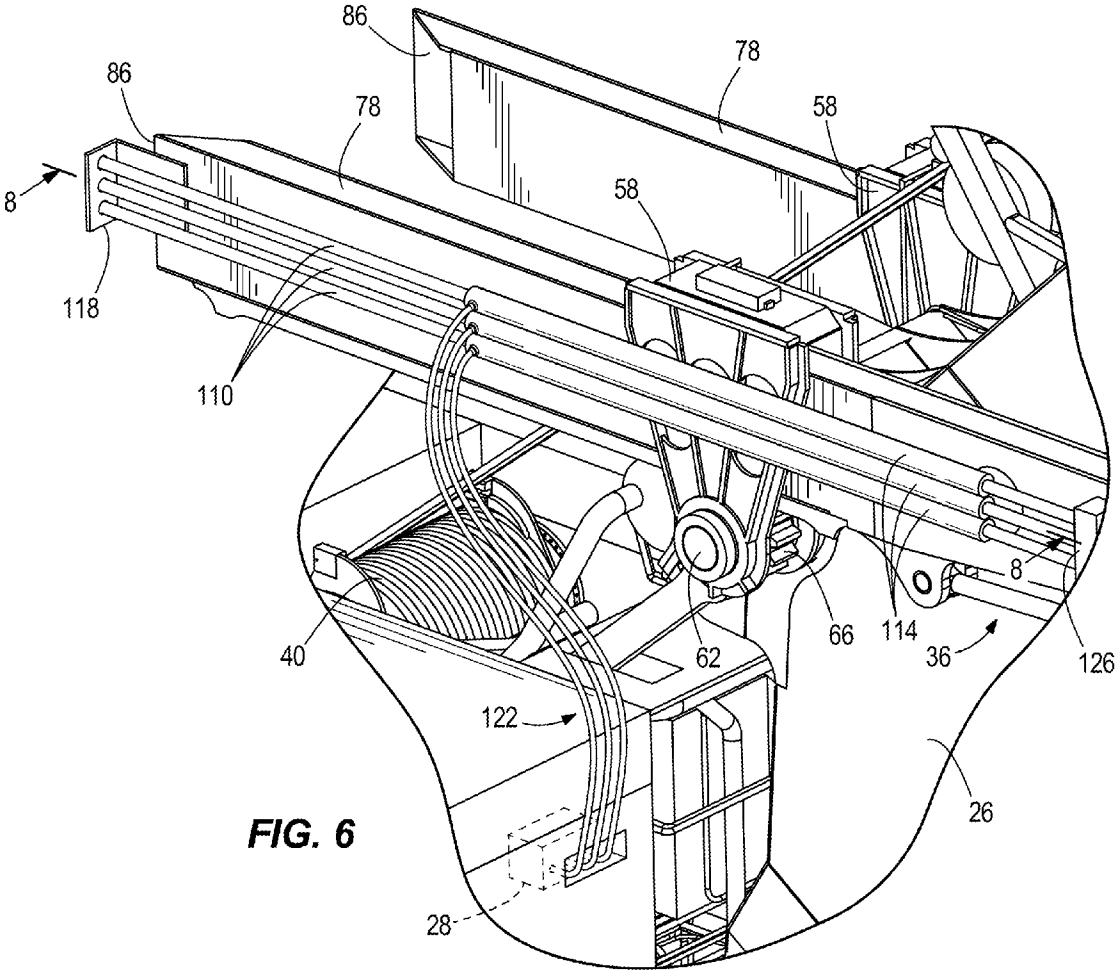
FIG. 6 is a perspective view of the fluid conveyance system with the handle retracted.

Referring to FIGS. 4-6, the fluid conveyance system 38 includes rods 110, hollow cylinders 114, and a rod support 118 positioned proximate an end of the cylinders 114. In the illustrated embodiment, each rod 110 is coupled to the handle 30, each cylinder 114 is coupled to the saddle block 58, and the rod support 118 is coupled to the second end 86 of the handle 30. Each cylinder 114 is in fluid communication with a first conduit 122. Each rod 110 extends through one of the cylinders 114 and is slidable with respect to the cylinder 114. The rod support 118 guides and supports the ends of the rods 110 exiting from the ends of the cylinders 114, thereby maintaining the alignment between the rods 110 and the cylinders 114. The rods 110 are also coupled to a manifold 126 positioned proximate the first end of the handle 30. In the illustrated embodiment, the fluid conveyance system 38 includes three rods 110 and three cylinders 114; in other embodiments, the system 38 may include fewer or more rods 110 and cylinders 114. In some embodiments, the fluid conveyance system 38 is positioned on both sides of the handle 30.

In the illustrated embodiment, the manifold 126 provides fluid communication between the rods 110 and the lines 130, which provide pressurized fluid to actuate the bucket 34 or other attachment. In one embodiment, lines 130*a*, 130*b* (FIG. 4) are in fluid communication with the pivot actuators 36 and line 130*c* (FIG. 4) is in fluid communication with a bucket actuator (not shown). In some embodiments, the lines 130 are in fluid communication with various mechanical connections (e.g., pin joints) on the bucket 34 and/or handle 30 and provide lubricative fluid to the connections. The lubricative fluid may be a liquid, solid, and/or semi-solid (e.g., grease). Alternatively, the cylinders 114 may convey multiple types of fluid (e.g., one cylinder conveys hydraulic fluid while another cylinder 114 conveys lubricative fluid).

Figure 7:
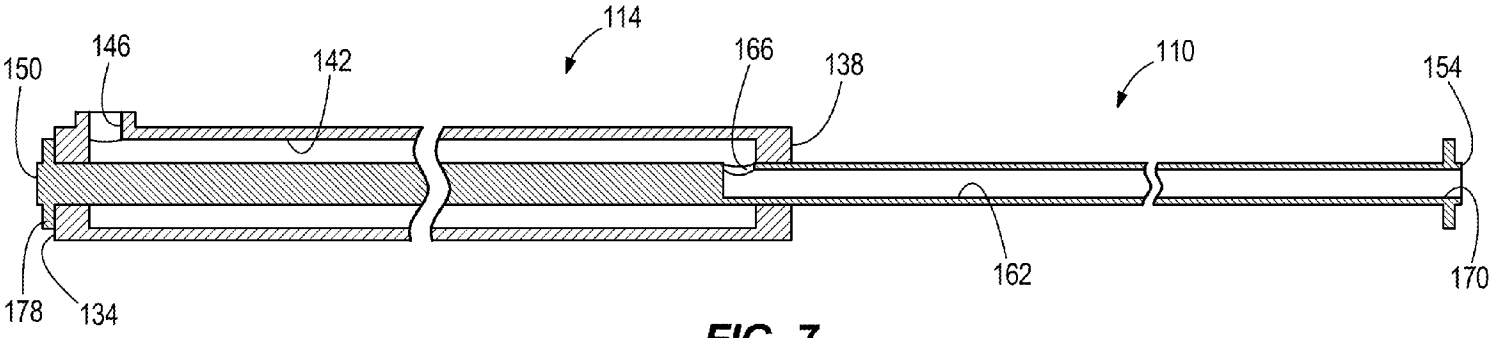
FIG. 7 is a cross section view of a cylinder and a rod of the fluid conveyance system shown in FIG. 5 taken along section 7-7.
Figure 8:
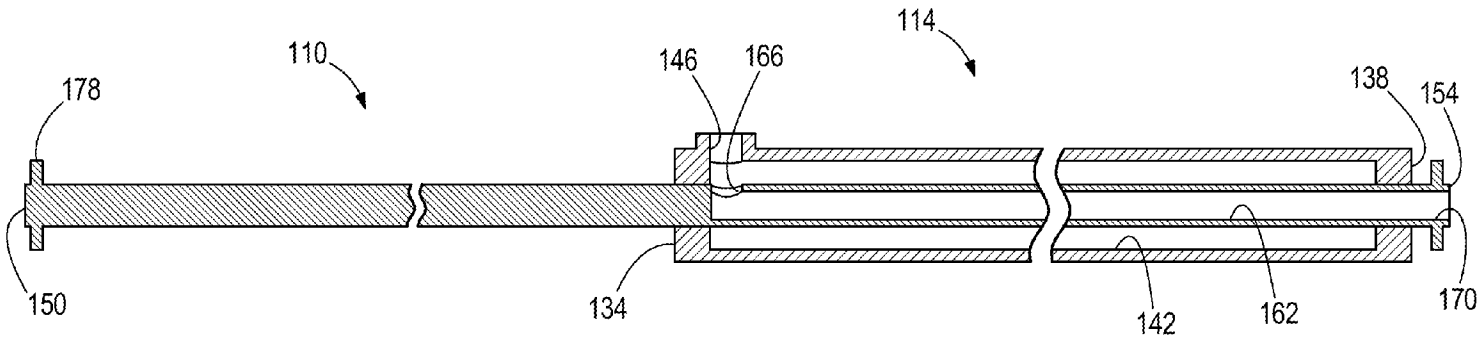
FIG. 8 is a cross section view of the cylinder and the rod of the fluid conveyance system shown in FIG. 6 taken along section 8-8.

As shown in FIGS. 7 and 8, each cylinder 114 defines a first end 134 and a second end 138. The cylinder 114 includes a first chamber or bore 142 and a cylinder port 146 providing fluid communication between the bore 142 and the first conduit 122 (FIG. 6). Each rod 110 defines a first end 150 and a second end 154. The rod 110 includes a second chamber or passage 162, a first rod port 166, and a second rod port 170. In the illustrated embodiment, the passage is formed as a hollow core extending at least partially through the rod 110. The first rod port 166 is positioned within the cylinder 114 and provides fluid communication between the bore 142 and the passage 162. The second rod port 170 is positioned proximate the first end 150 of the rod 110 and is in fluid communication with the manifold 126. In the illustrated embodiment, the first end 134 of each rod 110 also includes a stop or end cap 178 to limit the range of movement of the rod 110 relative to the cylinder 114. In other embodiments, the rod 110 may also include a stop positioned proximate the second end 138.

The first rod port 166 is positioned such that the first rod port 166 is always within the bore 142 during the full stroke of the rod 110, thereby insuring that the first rod port 166 always provides fluid communication between the bore 142 and the rod passage 162. Each end of the bore 142 is sealed to prevent fluid from leaking between the rod 110 and the cylinder 114. In one embodiment, the bore 142 is sealed against the rod 110 by radial seals extending between an inner surface of the bore 142 and an outer surface of the rod 110.

The handle 30 is extended or crowded so that the bucket 34 engages a bank of material. As the handle 30 moves away from the boom 26 toward an extended position (FIG. 5), each rod 110 slides relative to its respective cylinder 114 such that the first end 150 of the rod 110 moves away from the boom 26. Alternatively, as the handle 30 moves away from the bank toward a retracted position (FIG. 6), each rod 110 slides relative to its respective cylinder 114 such that the first end 150 of the rod 110 moves toward the boom 26. The retraction of the handle 30 causes the rods 110 to slide outwardly from the second end 138 of the cylinder 114 (FIG. 8). The rod support 118 supports the weight of the rods 110 as the rods 110 exit the cylinders 114 and maintains the rods 110 in alignment with the bores 142 (FIG. 8) of the cylinders 114.

Each first rod port 166 remains in fluid communication with the bore 142 during the entire stroke of the rod 110. Fluid flows from the source 28 via the first conduit 122, through the cylinder 114 via the cylinder port 146 and into the rod 110 via the first rod port 142. The fluid flows through the passage 162 and into the manifold 126, where it is then distributed to the actuators or lubrication points. The fluid conveyance system 38 thus transmits the fluid along the length of the handle 30 to the bucket 34 while accommodating the range of motion of the handle 30.

The bore 142 of the cylinder 114 provides a constant volume chamber, and the fluid in the bore 142 operates at a predetermined pressure that is substantially equal to the fluid pressure in the rod passage 162 at all times regardless of the extension of the handle 30. In addition, the fluid conveyance system 38 avoids the use of fluid hose that can be difficult to control and may snag on nearby obstacles or structures.

Thus, the invention provides, among other things, a fluid conveyance system for an industrial machine. Although the invention has been described in detail with reference to certain preferred embodiments, variations and modifications exist within the scope and spirit of one or more independent aspects of the invention as described. Various features and advantages of the invention are set forth in the following claims.

What is claimed is:

1. An industrial machine comprising:

a frame supporting a fluid source and a boom;

an arm movably coupled to the boom for translational and rotational movement relative to the boom;

an attachment coupled to the arm;

a cylinder including a first end and a second end, the cylinder defining an internal bore in fluid communication with the fluid source; and a rod coupled to the arm and slidably received within the cylinder, the rod including a port and a passage for providing fluid to the attachment, the port providing fluid communication between the internal bore and the passage, the port positioned within the internal bore throughout the entire range of movement of the rod relative to the cylinder, wherein the frame includes a saddle block pivotably coupled to the boom and supporting the arm for movement relative to the boom, wherein the cylinder is supported on the saddle block.

2. The industrial machine of claim 1, wherein the rod slidably extends through the first end and the second end of the cylinder, wherein translational movement of the arm relative to the boom causes the rod to slide relative to the cylinder.

3. The industrial machine of claim 1, further comprising a support bracket coupled to the arm proximate the second end, the support bracket supporting an end of the rod extending through the cylinder.

4. The industrial machine of claim 1, wherein the attachment includes a bucket coupled to the first end of the arm and an actuator for actuating the bucket, wherein the passage of the rod is in fluid communication with a conduit for supplying fluid to the actuator.

5. The industrial machine of claim 1, wherein the attachment is a bucket supported by a hoist cable extending over an end of the boom.

6. The industrial machine of claim 1, further comprising a support bracket secured to the arm and supporting an end of the rod.

7. The industrial machine of claim 1, wherein the frame supports the fluid source independently of the arm.

8. An industrial machine comprising:

a frame supporting a boom and a fluid source, the boom including a first end and a second end opposite the first end;

an elongated arm movably coupled to the boom, the elongated arm including a first end and a second end;

an attachment coupled to the first end of the elongated arm;

a first member coupled to the frame and having a first end and a second end, the first member defining a first chamber in fluid communication with the fluid source; and a second member at least partially extending through the first member, the second member including a second chamber in fluid communication with the first chamber and in fluid communication with the attachment, the second member movable relative to the first member as the arm moves relative to the boom, wherein the frame includes a saddle block pivotably coupled to the boom and supporting the arm for translational movement relative to the boom, wherein the first member is supported on the saddle block.

9. The industrial machine of claim 8, wherein the first member is a cylinder and the second member is a rod including a hollow core.

10. The industrial machine of claim 8, wherein the first member is pivotable with respect to the boom, and wherein the second member is coupled to the arm.

11. The industrial machine of claim 8, wherein the second member slidably extends through the first end and the second end of the first member, wherein translational movement of the arm relative to the boom causes the second member to slide relative to the first member.

12. The industrial machine of claim 11, wherein the second member includes a port that is positioned within the first chamber throughout the entire range of movement of the second member relative to the first member, the port providing fluid communication between the first chamber and the second chamber.

13. The industrial machine of claim 11, further comprising a support bracket coupled to the arm proximate the second end, the support bracket supporting an end of the second member extending through the first member.

14. The industrial machine of claim 8, wherein the attachment includes a bucket coupled to the first end of the arm and an actuator for actuating the bucket, wherein the second chamber of the second member is in fluid communication with the actuator.

15. The industrial machine of claim 14, further comprising a manifold coupled to the arm proximate the first end, wherein the second chamber supplies fluid to the manifold from the fluid source via the first chamber.

16. The industrial machine of claim 8, further comprising a support bracket secured to the arm and supporting an end of the second member.

17. The industrial machine of claim 8, wherein the frame supports the fluid source independently of the arm.

18. A fluid conveyance system for an industrial machine, the industrial machine having a frame supporting a boom including a saddle block, an arm having a first end and a second end and supported by the saddle block for movement relative to the boom, and an attachment coupled to the second end of the arm, the fluid conveyance system comprising:

a fluid source;

a conduit in fluid communication with the fluid source;

a cylinder including a first end and a second end, the cylinder defining an internal bore in fluid communication with the conduit; and a rod slidably received within the cylinder and supported by the arm, the rod including a port and a passage for providing fluid to the attachment, the port providing fluid communication between the internal bore and the passage, the port positioned within the internal bore throughout the range of movement of the rod relative to the cylinder, wherein the rod extends through the first end and second end of the cylinder, the rod including a first end and a second end, the first end of the rod positioned proximate the first end of the cylinder and the second end of the rod positioned proximate the second end of the cylinder.

19. The fluid conveyance system of claim 18, further comprising a manifold in fluid communication with the attachment, wherein the passage is positioned proximate the first end of the rod in fluid communication with the manifold.

20. The fluid conveyance system of claim 19, further comprising a support bracket supporting the rod proximate the second end.

* * * * *